US010077785B2

(12) United States Patent
Tsuji et al.

(10) Patent No.: US 10,077,785 B2
(45) Date of Patent: Sep. 18, 2018

(54) IMPELLER ASSEMBLY, TURBOCHARGER, AND METHOD OF ASSEMBLING IMPELLER ASSEMBLY

(71) Applicant: Mitsubishi Heavy Industries, Ltd., Tokyo (JP)

(72) Inventors: Takeshi Tsuji, Houston, TX (US); Ichiro Hirakawa, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 342 days.

(21) Appl. No.: 15/135,367

(22) Filed: Apr. 21, 2016

(65) Prior Publication Data

US 2017/0306980 A1 Oct. 26, 2017

(51) Int. Cl.
*F04D 29/054* (2006.01)
*F04D 29/62* (2006.01)
(Continued)

(52) U.S. Cl.
CPC ..... *F04D 29/624* (2013.01); *F02B 33/40* (2013.01); *F04D 25/06* (2013.01); *F04D 29/053* (2013.01);
(Continued)

(58) Field of Classification Search
CPC .... F04D 26/624; F04D 25/06; F04D 25/0606; F04D 29/626; F04D 29/263;
(Continued)

(56) References Cited

U.S. PATENT DOCUMENTS 7,692,326 B2 * 4/2010 Ono ..... F01D 5/026 290/52
2008/0203732 A1 8/2008 Ono et al.
(Continued)

FOREIGN PATENT DOCUMENTS

JP S59133824 A 8/1984
JP H10-002317 A 1/1998
(Continued)

OTHER PUBLICATIONS

International Search Report, App. No. PCT/JP2017/015052, dated Jun. 27, 2017, 9 Pages.

*Primary Examiner* — Logan Kraft
*Assistant Examiner* — Sabbir Hasan
(74) *Attorney, Agent, or Firm* — Berkeley Law & Technology Group, LLP

(57) ABSTRACT

An impeller assembly includes: a compressor impeller; a flange member in which a shaft is inserted, the flange member having an abutting portion to abut on an upstream-side end surface, in an axis line direction, of the hub, and an impeller-side flange portion provided on an upstream side, in the axis line direction, of the abutting portion and protruding outward in a radial direction; a nut screwed on a tip portion of the shaft so as to hold the flange member between the nut and the end surface of the hub; a rotor of an electric generator or an electric motor, the rotor having a rotor-side flange portion disposed on an opposite to the hub across the impeller-side flange portion; and a fastening member fastening the impeller-side flange portion and the rotor-side flange portion to each other.

9 Claims, 6 Drawing Sheets

(51) Int. Cl.

| | |
|---|---|
| ***F02B 33/40*** | (2006.01) |
| ***F04D 25/06*** | (2006.01) |
| ***F04D 29/053*** | (2006.01) |
| *F04D 29/28* | (2006.01) |

(52) U.S. Cl.
CPC ..... *F04D 29/054* (2013.01); *F04D 29/284* (2013.01); *F05D 2220/40* (2013.01); *F05D 2230/60* (2013.01); *F05D 2260/36* (2013.01)

(58) Field of Classification Search
CPC .... F04D 29/266; F04D 29/053; F04D 29/054; F04D 29/284
See application file for complete search history.

(56) References Cited

U.S. PATENT DOCUMENTS

| | | | | |
|---|---|---|---|---|
| 2013/0239568 | A1 | 9/2013 | Krishnan et al. | |
| 2016/0153471 | A1 * | 6/2016 | Oda ..... | F04D 17/12 415/121.2 |

FOREIGN PATENT DOCUMENTS

| | | | | |
|---|---|---|---|---|
| JP | 2008208735 | A | 9/2008 | |
| JP | 46448347 | B2 | 12/2010 | |
| JP | 2014173639 | A * | 9/2014 | |
| JP | 2015158161 | A | 9/2015 | |
| JP | WO 2015133303 | A1 * | 9/2015 | ..... F02B 37/10 |

* cited by examiner

IMPELLER ASSEMBLY, TURBOCHARGER, AND METHOD OF ASSEMBLING IMPELLER ASSEMBLY

TECHNICAL FIELD

This disclosure relates to an impeller assembly, a supercharger, and a method of assembling impeller assembly.

BACKGROUND

Superchargers are widely used as an auxiliary device to provide high combustion energy by an internal combustion engine. For example, an exhaust gas turbine-type supercharger (i.e. turbocharger) is configured to compress air to be supplied to an internal combustion engine by causing exhaust gas from the internal combustion engine to rotate a turbine rotor to obtain a driving force and by causing a compressor impeller to rotate by using the driving force.

A hybrid turbocharger, which is a type of superchargers, has an electric generator. In a hybrid turbocharger, the rotor of the electric generator and the compressor impeller are connected to each other via a coupling member to constitute the impeller assembly. With such a supercharger, electric power is obtained by rotating the generator by the driving force of the turbine rotor obtained from excessive exhaust gas energy.

A power assisted turbocharger, which is another type of superchargers, has a built-in electric motor. In a power assisted turbocharger, the rotor of the electric motor and the compressor impeller are connected to each other via a coupling member to constitute the impeller assembly. With such a supercharger, the compressor is driven by supplementarily using the driving force of the electric motor when the amount of the exhaust gas to drive the turbine is small, for example, at the time of low load operation of the internal combustion engine.

Patent Document 1 discloses a power assisted turbocharger having a rotor overhang structure where the rotor of the electric motor is supported in the manner of the cantilever on the tip portion of the shaft which is inserted in the compressor impeller.

In the power assisted turbocharger disclosed in Patent Document 1, the electric motor is mainly composed of a motor rotor, a stator and a casing. Among them, the motor rotor is a member having a cylindrical structure and having a magnet portion on its outer circumferential side, and one end portion of the motor rotor is connected to the tip portion of the shaft inserted in the compressor impeller by means of a flange coupling. That is, a flange member mounted on the tip portion of the shaft and a flange portion provided on one end portion of the motor rotor are joined to each other with a plurality of bolts and nuts.

CITATION LIST

Patent Literature

Patent Document 1: JP 2015-158161 A

SUMMARY

Although Patent Document 1 does not specify mounting parts to mount the flange members on the tip portion of the shaft, the mounting parts for the flange members shown in FIG. 5 of Patent Document 1 are large in number and complicated, and thus the configuration of the impeller assembly is also complicated.

In view of the above problem, at least an embodiment of the present invention is to provide an impeller assembly having a compressor impeller and a rotor of an electric motor or an electric generator which are connected to each other in a simple manner, a supercharger including such an impeller assembly, and a method for assembling such an impeller assembly.

(1) An impeller assembly according to at least one embodiment of the present invention comprises: a shaft; a compressor impeller having a hub in which the shaft is inserted and having a plurality of rotor blade provided on an outer circumferential surface and at intervals in a circumferential direction; a flange member in which the shaft is inserted, the flange member having an abutting portion to abut on an upstream-side end surface, in an axis line direction, of the hub, and an impeller-side flange portion provided on an upstream side, in the axis line direction, of the abutting portion and protruding outward in a radial direction; a nut to be screwed on a tip portion of the shaft so as to press the flange member against the end surface of the hub; a rotor of an electric generator or an electric motor, the rotor having a rotor-side flange portion disposed on an opposite to the hub across the impeller-side flange portion; and a fastening member fastening the impeller-side flange portion and the rotor-side flange portion to each other.

With the impeller assembly described in the above (1), the flange member is pressed against the end surface of the hub by the tightening force (axial force) of the nut. Thus, by suitably setting the tightening force of the nut, it is possible to fix the flange member to the end surface of the hub not by bolt fixation but by friction fixation. That is, by the friction force between the abutting portion of the flange member and the end surface of the hub and the friction force between the surface on the rotor side of the flange member and the end surface of the nut, it is possible to assemble the flange member, the compressor impeller and the nut together so as not to permit them to rotate relatively to one another. Accordingly, it is possible to reduce the number of the parts to mount the flange member on the end surface of the hub and to simplify the configuration of the impeller assembly as compared to the impeller assembly disclosed in Patent Document 1.

Further, in contrast to the impeller assembly disclosed in Patent Document 1, since a mounting part is not necessary between the flange member and the end surface of the hub, it is possible to reduce the distance between the hub and the rotor of the electric generator or the electric motor. Accordingly, when the impeller assembly has a rotor overhang structure, it is possible to reduce the rotor overhang amount to suppress vibration of the shaft, which is advantageous in the rotor dynamics.

Further, while the impeller assembly disclosed in Patent Document 1 has a bolt hole, which is formed on the end surface of the hub, to mount the flange member on the end surface of the hub, the impeller assembly described in the above (1) does not need a bolt hole on the end surface of the hub because the flange member can be fixed not by bolt fixation but by friction fixation, as described above. Accordingly, retrofitting such that a rotor of an electric generator or an electric motor is additionally provided to a compressor impeller may be easily performed.

(2) In some embodiments, in the impeller assembly described in the above (1), the rotor and the flange member are assembled together by means of socket-and-spigot joint.

According to the above impeller assembly described in the above (2), it is possible to align the axial center of the rotor and the axial center of the flange member with each other with a simple configuration. That is, it is possible to align the axial center of the rotor and the axial center of the shaft with a simple configuration.

(3) In some embodiments, in the impeller assembly described in the above (1) and (2), the fastening member includes a flange fastening bolt for fastening the impeller-side flange portion and the rotor-side flange portion to each other. The rotor-side flange portion has an outer circumferential surface having an inclined surface such that a distance between the inclined surface and the axis line becomes larger toward the downstream side. A spot facing portion accommodating a head portion of the flange fastening bolt is provided on the inclined surface.

According to the impeller assembly described in the above (3), it is possible to smoothly introduce an air flow having passed through between the stator and the rotor of the electric generator or the electric motor to the rotor blades by the inclined surface. Further, by providing the spot facing portion on the inclined surface for accommodating the head portion of the flange fastening bolt, it is possible to reduce windage losses caused on the head portion of the flange fastening bolt and to suppress increase in the outside diameter of the rotor-side flange portion.

(4) In some embodiments, in the impeller assembly described in any one of the above (1) to (3), the end surface of the hub has a hub concave portion formed. The abutting portion abuts on a bottom surface of the hub concave portion, in the end surface. The nut is screwed on the tip portion of the shaft so as to hold the flange member between the nut and the bottom surface of the hub concave portion.

According to the impeller assembly described in the above (4), since the abutting portion of the flange member is accommodated in the hub concave portion, it is possible to reduce the size of the impeller assembly in the axis line direction. Further, since the impeller-side flange portion and the rotor-side flange portion may be provided in a position close to the end surface of the hub, when the above-described rotor overhang structure is employed, it is possible to permit the center of gravity of the rotor to be closer to the end surface of the hub and thereby to suppress vibration of the shaft.

(5) In some embodiments, in the impeller assembly described in any one of the above (1) to (4), the flange member has a flange member concave portion on a surface on a rotor side. The rotor has a rotor concave portion on a surface on a flange member side. The nut is screwed on the shaft so as to exert a pressing force on a bottom surface of the flange member concave portion and is accommodated in a nut accommodation space formed by the flange member concave portion together with the rotor concave portion.

According to the impeller assembly described in the above (5), it is possible to reduce the number of parts to mount the flange member on the end surface of the hub and to reduce the size of the impeller assembly in the axial line direction.

(6) In some embodiments, in the impeller assembly described in any one of the above (1) to (5), the rotor includes a rotor body portion having a magnet portion, and a flexible coupling for connecting the rotor body portion and the flange member. The rotor-side flange portion is provided on one end side of the flexible coupling.

With the above impeller assembly described in the above (6) including a flexible coupling which permits decentering, difference in angle or swinging between the rotational axis of the rotor body portion and the rotational axis of the flange member, it is also possible to reduce the number of the parts to mount the flange member on the end surface of the hub and thereby to simplify the configuration of the impeller assembly, as described in the above (1). Since it is possible to fix the flange member to the end surface of the hub not by bolt fixation but by friction fixation, as described in the above (1), a bolt hole is not needed on the end surface of the hub. Accordingly, retrofitting such that a rotor of an electric generator or an electric motor is additionally provided to a compressor impeller may be easily performed.

(7) A supercharger according to at least one embodiment of the present invention comprises the impeller assembly described in any one of the above (1) to (6).

According to the supercharger described in the above (7), by including the impeller assembly described in any one of the above (1) to (6), it is possible to simplify the configuration of the impeller assembly and thereby to simplify the configuration of the supercharger. Further, retrofitting of additionally providing an electric motor or an electric generator to a supercharger may be easily performed.

(8) A method for assembling a compressor impeller assembly according to at least one embodiment of the present invention is a method for assembling a compressor impeller including:

a shaft; a compressor having a hub and a plurality of rotor blade provided on an outer circumferential surface and at intervals in a circumferential direction; a flange member having an abutting portion to abut on an upstream-side end surface, in an axis line direction, of the hub, and an impeller-side flange portion to be provided on an upstream side, in the axis line direction, of the abutting portion and protruding outward in a radial direction; a nut to be screwed on a tip portion of the shaft; and a rotor of an electric generator or an electric motor. The method comprises: an impeller inserting step of inserting the shaft into the compressor impeller; a flange member inserting step of inserting the shaft into the flange member and permitting the abutting portion to abut on the end surface of the hub; a nut screwing step of screwing the nut on the tip portion of the shaft so that the flange member is held between the nut and the end surface of the hub; and a fastening step of fastening the impeller-side flange portion and the rotor-side flange portion with a fastening member.

By the method for assembling a compressor impeller assembly described in the above (8), the flange member is pressed against the end surface of the hub by the tightening force (axial force) of the nut in the nut screwing step. Thus, by suitably setting the tightening force of the nut, it is possible to fix the flange member to the end surface of the hub not by bolt fixation but by friction fixation. That is, by the friction force between the abutting portion of the flange member and the end surface of the hub and the friction force between the surface on the rotor side of the flange member and the end surface of the nut, it is possible to assemble the flange member, the compressor impeller and the nut together so as not to permit them to rotate relatively to one another. Accordingly, since a mounting part to mount the flange member on the end surface of the hub is not necessary, it is possible to reduce the number of steps of assembling the impeller assembly, as compared to the method of assembling the impeller assembly disclosed in Patent Document 1.

(9) In some embodiments, in the method for assembling an impeller assembly described in the above (8), the nut screwing step includes: a temporary tightening step of tightening the nut temporarily; and a final tightening step of tightening the nut finally while applying a tensile force to a part of the shaft, the part being closer to a tip of the shaft than the nut having been temporarily tightened.

According to the method for assembling an impeller assembly described in the above (9), since in the final tightening step, the final tightening of the nut is performed while a tensile force is applied to the part of the shaft, which is closer to the tip of the shaft than the nut which has been temporarily tightened in the temporary tightening step, it is possible to perform the final tightening of the nut while the shaft is elongated. Accordingly, by releasing the shaft after the final tightening (i.e. by stopping applying tensile force to the shaft), it is possible to tightly fix the nut to the shaft while the flange member is strongly pressed against the end surface of the hub. Accordingly, it is possible to improve the effect of not permitting the flange member, the compressor impeller and the nut to rotate relatively to one another.

According to at least an embodiment of the present invention, an impeller assembly having a compressor impeller and a rotor of an electric motor or an electric generator which are connected to each other in a simple manner, a supercharger including such an impeller assembly, and a method for assembling such an impeller assembly.

DETAILED DESCRIPTION

Embodiments of the present invention will now be described with reference to the accompanying drawings. It is intended, however, dimensions, materials, shapes, relative positions and the like of components described in the embodiments or the drawings shall be interpreted as illustrative only and not limitative of the scope of the present invention.

For instance, an expression of an equal state such as "same" "equal" and "uniform" shall not be construed as indicating only the state in which the feature is strictly equal, but also includes a state in which there is a tolerance or a difference that can still achieve the same function.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

An expression such as "comprise", "include", "have", "contain" and "constitute" are not intended to be exclusive of other components.

Figure 1:
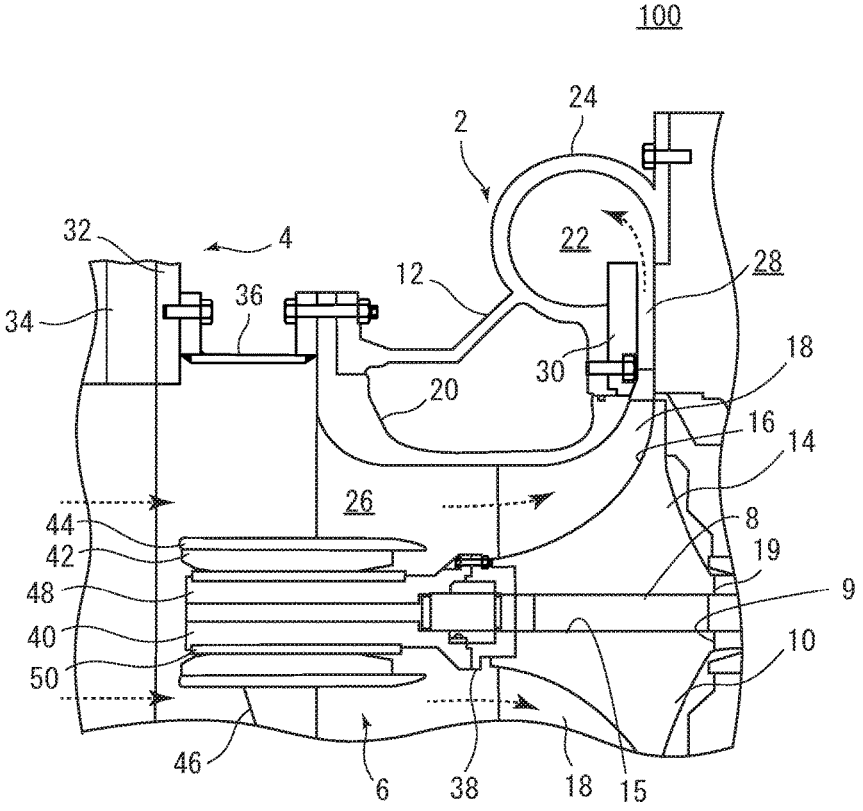
FIG. 1 is a cross-sectional view illustrating a configuration of compressor 2 of supercharger 100 and the vicinity according to an embodiment.

FIG. 1 is a cross-sectional view illustrating a configuration of a compressor 2 of a supercharger 100 and the vicinity according to an embodiment.

The supercharger 100 is a power assisted turbocharger having a built-in motor 6, and it comprises a compressor 2, a silencer 4 and the motor 6.

The compressor 2 includes a compressor impeller 10 connected to a turbine rotor (not shown) via a shaft 8, and a compressor casing for accommodating the compressor impeller 10. Hereinafter, the direction of the axis line of the shaft 8 (the direction of the axis line of the compressor impeller 10) will be referred to simply as "the axis line direction", the radial direction of the shaft 8 (the radial direction of the compressor impeller 10) as "the radial direction", and the circumferential direction of the shaft 8 (circumferential direction of the compressor impeller 10) as "circumferential direction".

The compressor impeller 10 includes a hub 14 having a through-hole 15 in which the shaft is inserted, and a plurality of rotor blades 18 provided on the outer circumferential surface 16 of the hub 14 and at intervals in the circumferential direction. The position of the compressor impeller 10 in the axis line direction is defined by a rear surface 19 of the hub 14 and a stepped portion 9 of the shaft 8 which abut on each other.

The compressor casing 12 includes an air inlet casing 20 covering the compressor impeller 10, a scroll casing 24 forming a scroll flow passage 22, and a diffuser member 30 forming a diffuser flow path 28 which connects the flow passage 26 inside the air inlet casing 20 and the scroll flow passage 22.

The silencer 4 is connected to the intake side of the compressor 2, and it includes a silencer casing 32 and a silencer element 34 provided inside the silencer casing 32 so as to reduce noises from the compressor 2. The silencer 4 is configured to introduce air taken from the outside toward the flow passage 26 inside the air inlet casing 20 of the compressor 2 and along the direction of the axis line of the shaft 8. The air inlet casing 20 and the silencer casing 32 are coupled to each other via a coupling casing 36 having a tubular shape.

The motor 6 includes a motor rotor 40 coupled to the compressor impeller 10 via a flange member 38, a stator 42 (winding part) provided around the motor rotor 40, a tubular motor casing 44 covering the stator 42, and a supporting member 46 for supporting the motor casing 44. The motor rotor 40 has a rotor core 48 having a cylindrical shape and a magnet portion 50 fixed to the outer circumferential surface of the rotor core 48, and it has a cylindrical overall shape. In the embodiment illustrated in the drawing, the supercharger 100 has a rotor overhang structure where the motor rotor 40 is supported in the manner of the cantilever on the tip portion 64 of the shaft 8. Apart of the motor 6 is housed in the coupling casing 36, and another part of the motor 6 is housed in the air inlet casing 20.

The supercharger 100 is configured to convert energy of exhaust gas from an internal combustion engine (e.g. a diesel engine for ship; not shown) into rotational energy of a turbine rotor (not shown) to rotate the compressor impeller coupled to the turbine rotor via the shaft 8, whereby the air introduced from the silencer is compressed and then supplied to the internal combustion engine. In the supercharger 100, the compressor impeller 10 is rotationally driven by supplementarily using the driving force of the motor 6 when the amount of the exhaust gas to rotationally drive the turbine rotor is small, for example, at the time of low load operation of the internal combustion engine.

Figure 2:
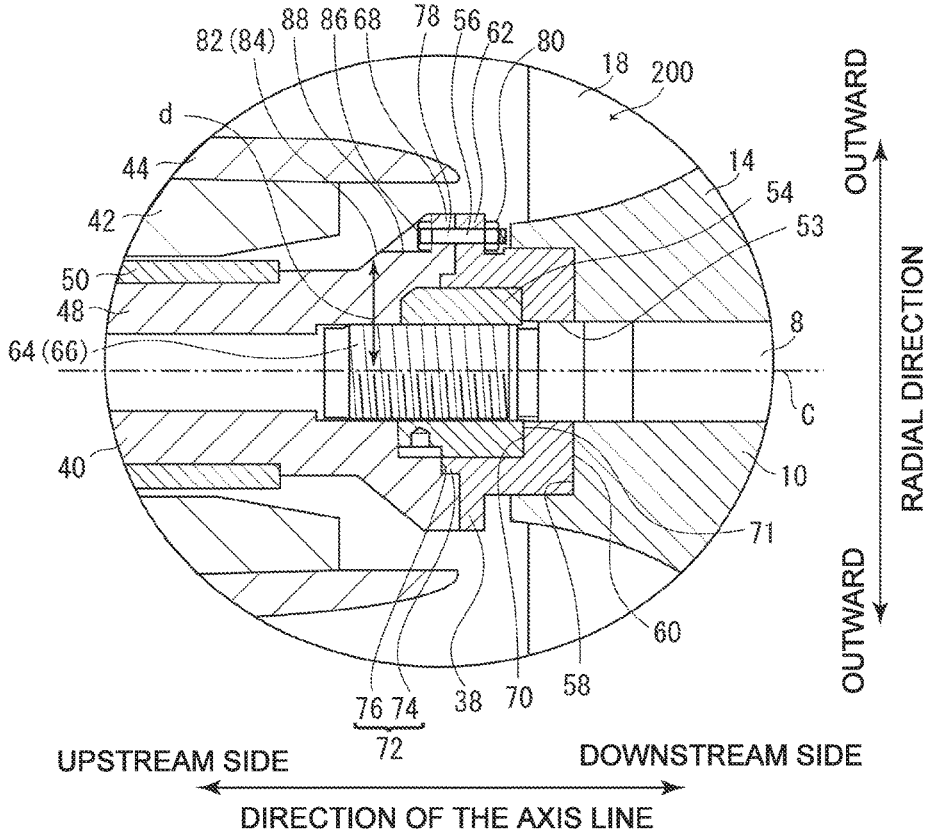
FIG. 2 is an enlarged view of connecting portion between motor rotor 40 and compressor impeller 10 shown in FIG. 1.
Figure 3:
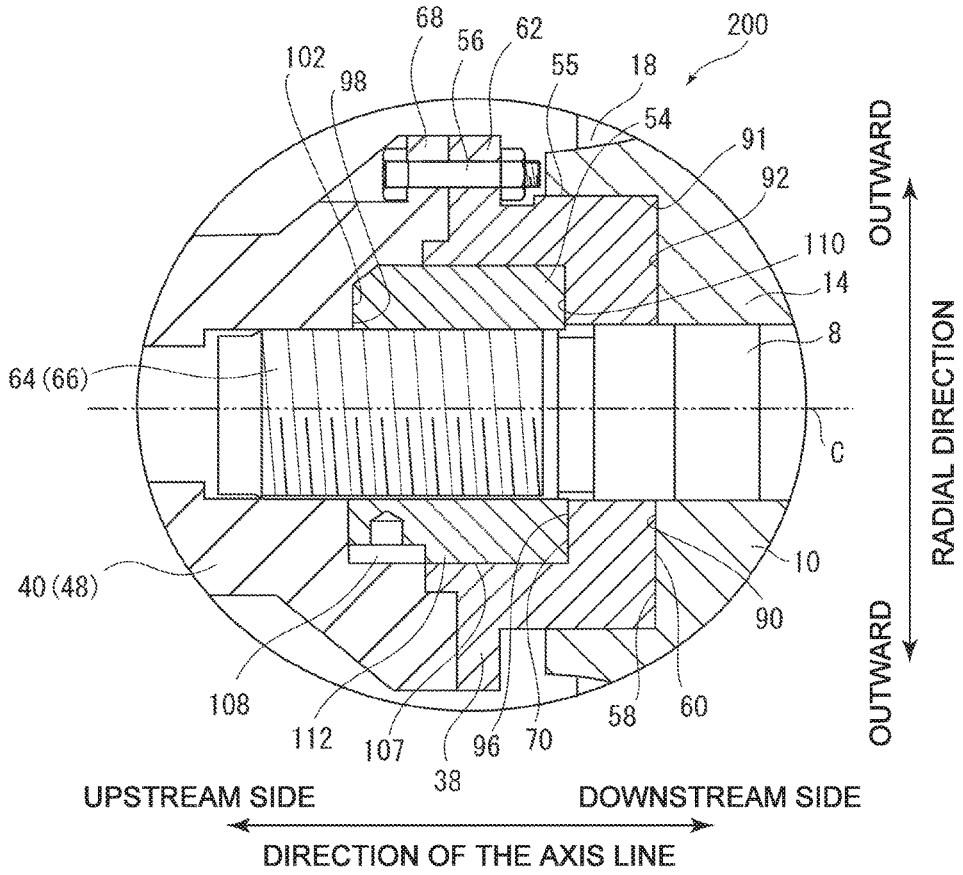
FIG. 3 is an enlarged view of connecting portion between motor rotor 40 and compressor impeller 10 shown in FIG. 2.

FIG. 2 is an enlarged view of a connecting portion between the motor rotor 40 and the compressor impeller 10 shown in FIG. 1. FIG. 3 is an enlarged view of the connecting portion between the motor rotor 40 and the compressor impeller 10 shown in FIG. 2.

As illustrated in FIG. 2, for example, the supercharger 100 includes the flange member 38 for coupling the compressor impeller 10 and the motor rotor 40 to each other, a nut 54 for fixing the compressor impeller 10 and the flange member 38 to the shaft 8, and a fastening member 56 for fastening the flange member 38 and the motor rotor 40 to each other. In the supercharger 100, the shaft 8, the compressor impeller 10, the flange member 38, the motor rotor 40, the nut 54 and the fastening member 56 are assembled together to constitute an impeller assembly 200.

The flange member 38 is a tubular member having a through-hole 53 in which the shaft 8 is inserted. The flange member 38 includes an abutting portion 60 abutting on an upstream-side end surface 58 of the hub 14 on an upstream side in the axis line direction, and an impeller-side flange portion 62 provided on an upstream side, in the axis line direction, of the abutting portion 60 and protruding outward in the radial direction.

The nut 54 is screwed on a screw portion 66 formed on the tip portion 64 of the shaft so as to hold the flange member 38 between the nut 54 and the end surface 58 of the hub 14.

The rotor core 48 of the motor rotor 40 includes a rotor-side flange portion 68 abutting on the impeller-side flange portion 62 on the opposite side to the hub 14 across the impeller-side flange portion 62. The fastening member 56 is configured to fasten the impeller-side flange portion 62 and the rotor-side flange portion 68 to each other.

With the above configuration, the flange member 38 is pressed against the end surface 58 of the hub 14 by the tightening force (axial force) of the nut 54. Thus, by suitably setting the tightening force of the nut 54, it is possible to fix the flange member 38 to the end surface 58 of the hub 14 not by bolt fixation but by friction fixation. That is, by the friction force between the abutting portion 60 of the flange member 38 and the end surface 58 of the hub 14 and the friction force between the surface 70 on the motor rotor 40 side of the flange member 38 and the end surface 71 of the nut 54, it is possible to assemble the flange member 38, the compressor impeller 10 and the nut 54 together so as not to permit them to rotate relatively to one another. Accordingly, it is possible to reduce the number of the parts to mount the flange member 38 on the end surface 58 of the hub 14 and to simplify the configuration of the impeller assembly as compared to the impeller assembly disclosed in Patent Document 1.

Further, in contrast to the impeller assembly disclosed in Patent Document 1, since a mounting part is not necessary between the flange member 38 and the end surface 58 of the hub 14, it is possible to reduce the distance between the motor rotor 40 and the hub. Accordingly, as will be described later, it is possible to reduce the overhang amount of the motor rotor 40 to suppress vibration of the shaft 8 and thereby to improve dynamic response and stability of the shafting. Further, since it is possible to reduce the overhang amount of the motor rotor 40, the degree of freedom for the design may be increased, whereby it is possible to ease restrictions for the size and weight of the motor 6 itself. Accordingly, it is possible to employ a motor 6 which is capable of providing a larger output.

Further, while the impeller assembly disclosed in Patent Document 1 has a bolt hole, which is formed on the end surface of the hub, to mount the flange member on the end surface of the hub, the above-described impeller assembly 200 does not need a bolt hole on the end surface 58 of the hub 14 because the flange member 38 can be fixed not by bolt fixation but by friction fixation, as described above. Accordingly, retrofitting such that a motor rotor 40 is additionally provided to the compressor impeller 10 may be easily performed.

Figure 7:
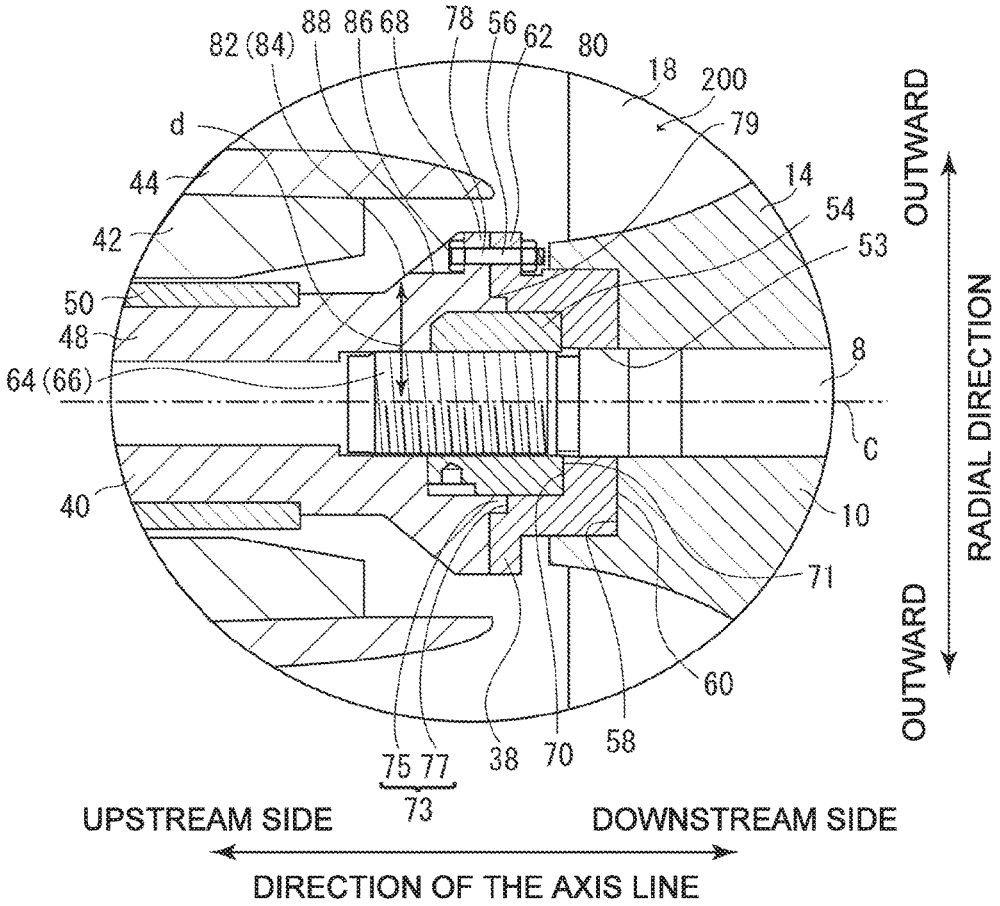
FIG. 7 show a modified example of connecting portion between motor rotor 40 and compressor impeller 10.

In an embodiment, as illustrated in FIG. 2, for example, the motor rotor 40 and the flange member 38 are assembled together by means of socket-and-spigot joint. In the illustrated embodiment, the flange member 38 has a convex portion 74 (i.e. "spigot" for the socket-and-spigot joint) which has an annular shape and which protrudes toward the upstream side (i.e. the motor rotor 40 side) in the axis line direction from the impeller-side flange portion 62, and the motor rotor 40 has a concave portion 76 (i.e. "socket" for the socket-and-spigot joint) in which the convex portion 74 is fitted. The convex portion 74 is disposed adjacently to the nut 54 on the outer circumferential side of the nut 54, and the convex portion 74 and the concave portion 76 together constitute a socket-and-spigot joint structure 72. In an embodiment, as shown in FIG. 7, the motor rotor 40 may have a convex portion 75 which has an annular shape and which protrudes toward the downstream side (i.e. the compressor impeller 10 side) in the axis line direction from the rotor-side flange portion 68. In this case, the flange member 38 has a concave portion 77 in which the convex portion 75 is fitted; and the convex portion 75 is disposed adjacently to the nut 54 on the outer circumferential side of the nut 54, and the convex portion 75 and the concave portion 77 together constitute a socket-and-spigot joint structure 73.

According to the above configuration, since the motor rotor 40 and the flange member 38 are assembled together by means of socket-and-spigot joint, it is possible to align the axial center of the motor rotor 40 and the axial center of the flange member 38 with each other with a simple configuration. That is, it is possible to align the axial center of the motor rotor 40 and the axial center of the shaft 8 with a simple configuration. In the embodiment illustrated in FIG. 7, a base end portion 79 of the convex portion 75 may be likely to be subjected to a stress due to a bending moment; however, it is possible with the convex portion 75 to suppress inclination of the rotor-side flange portion 68 due to the self-weight of the motor rotor 40. In the embodiment illustrated in FIG. 2, since the motor rotor 40 does not have the convex portion 75, it is possible to suppress stress concentration to the vicinity of the rotor-side flange portion 68 in the motor rotor 40.

In an embodiment, as shown in FIG. 2, for example, the fastening member 56 includes a flange fastening bolt 78 for fastening the impeller-side flange portion 62 and the rotor-side flange portion 68 to each other, and a flange fastening nut 80 screwed on the flange fastening bolt 78. The outer circumferential surface 82 of the rotor-side flange portion 68 has an inclined surface 84 such that a distance d between the inclined surface 84 and the axis line C becomes larger toward the downstream side, and the inclined surface 84 is provided with a spot facing portion 88 for accommodating a head portion 86 of the flange fastening bolt 78. As the flange fastening bolt 78, a reamer bolt may be used in terms of the accuracy of mounting.

Figure 4:
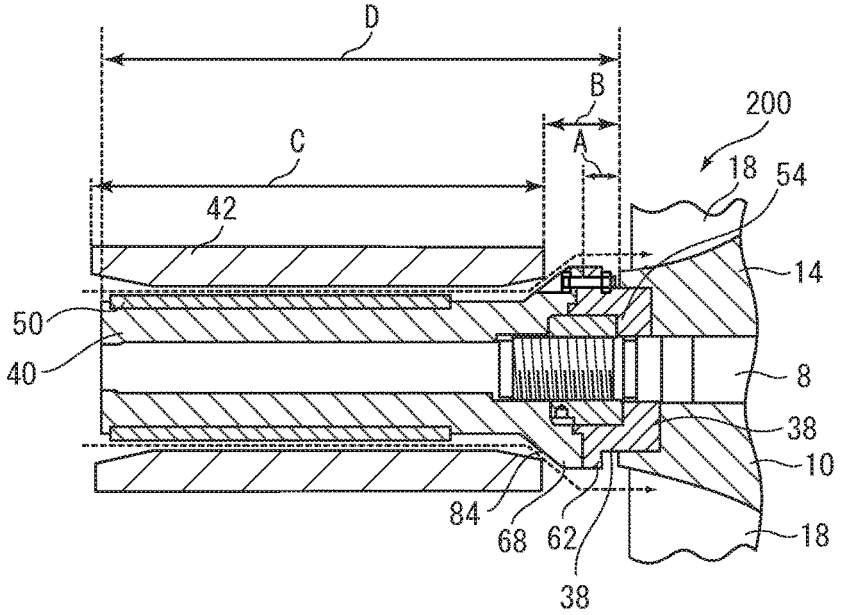
FIG. 4 is a schematic cross-sectional view illustrating a configuration of impeller assembly 200 and stator 42.

According to the above configuration, as shown in FIG. 4, it is possible to smoothly introduce an air flow (dashed arrow in the drawing) having passed through between the motor rotor 40 and the stator 42 along the axis line direction to the rotor blades 18 of the compressor impeller 10 by the inclined surface 84. Further, by providing the spot facing portion 88 on the inclined surface 84 for accommodating the head portion 86 of the flange fastening bolt 78, it is possible to reduce windage losses caused on the head portion 86 of the flange fastening bolt 78 and to suppress increase in the outside diameter of the rotor-side flange portion 68.

In an embodiment, as shown in FIG. 3, for example, a hub concave portion 90 is formed on the end surface 58 of the hub 14, and the abutting portion 60 abuts on the bottom surface 92 of the hub concave portion 90, in the end surface 58. The flange member 38 has a mating portion 55 mating the inner circumferential surface 91 of the hub concave portion 90. The nut 54 is screwed on the tip portion 64 of the shaft 8 so as to hold the flange member 38 between the nut 54 and the bottom surface 92 of the hub concave portion 90.

According to the above configuration, since the abutting portion 60 of the flange member 38 is accommodated in the hub concave portion 90, it is possible to reduce the size of the impeller assembly 200 in the axis line direction. Further, since the impeller-side flange portion 62 and the rotor-side flange portion 68 may be provided in a position close to the end surface 58 of the hub 14, it is possible to permit the center of gravity of the motor rotor 40 to be closer to the end surface 58 of the hub 14. It is thereby possible to suppress vibration of the shaft 8 and thereby to improve dynamic response and stability of the shafting.

In an embodiment, as shown in FIG. 3, for example, the flange member 38 has a flange member concave portion 96 on a surface 70 on the motor rotor 40 side, and the rotor core 48 of the motor rotor 40 has a rotor concave portion 102 on a surface 98 on the flange member side. The nut 54 is screwed on the shaft 8 so as to exert a pressing force on a bottom surface 110 of the flange member concave portion 96 and is accommodated in a nut accommodation space 112 formed by the flange member concave portion 96 together with the rotor concave portion 102.

According to the above configuration, it is possible to reduce the number of parts to mount the flange member 38 on the end surface 58 of the hub 14 and to reduce the size of the impeller assembly 200 in the axial line direction.

In assembling of the impeller assembly, when screwing the nut 54 on the screw portion 66, it may be that firstly, the nut 54 is temporarily tightened until the nut 54 abuts on the flange member 38, and then, the nut 54 is finally tightened with a jig inserted in a jig hole 108 provided on a lateral surface (outer circumferential surface) 107 of the nut 54 while applying a tensile force to a part of the tip portion 64 of the shaft 8, which part is closer to the tip of the shaft 8 than the nut 54 having been temporarily tightened, along the axis line direction by using e.g. a hydraulic chuck. In this case, since it is possible to finally tighten the nut 54 while the shaft 8 is elongated, by releasing the tip portion 64 of the shaft 8 after the final tightening (i.e. by stopping applying tensile force), it is possible to tightly fix the nut 54 to the shaft 8 while the flange member 38 is strongly pressed against the end surface 58 of the hub 14.

Figure 5:
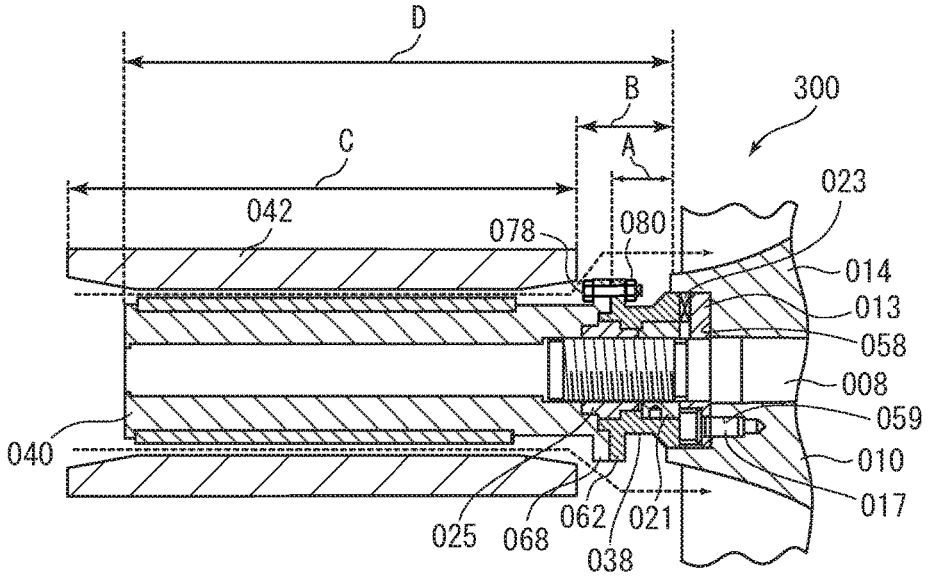
FIG. 5 is a schematic cross-sectional view illustrating a configuration of impeller assembly 300 and stator 042 according to a comparative embodiment.

Here, with reference to FIG. 4 and FIG. 5, the above-described impeller assembly 200 will be compared with an impeller assembly 300 as a comparative embodiment.

FIG. 4 is a schematic cross-sectional view illustrating a configuration of the impeller assembly 200 and the stator 42. FIG. 5 is a schematic cross-sectional view illustrating a configuration of an impeller assembly 300 and a stator 042 according to a comparative embodiment.

In the impeller assembly 300 according to a comparative embodiment, a washer 013 through which the shaft 008 is inserted is fixed to an end surface 058 of a hub 014 of a compressor impeller 010 with a washer fixing bolt 017. The washer 013 is pressed against the end surface 058 of the hub 014 by tightening force (axial force) of a nut 021 screwed on the shaft 008, and the washer 013 is held between the nut 021 and the hub 014. A flange member 038 is mounted on the washer 013 via a claw 023, and the flange member 038 is pressed against the washer 013 by tightening force (axial force) of a nut 025 screwed on the shaft 008. The impeller-side flange 062 of the flange member 038 and the rotor-side flange 068 of the motor rotor 040 are fastened to each other with a flange fastening bolt 078 and a flange fastening nut 080.

According to the present inventor, the impeller assembly 200 according to the above-described embodiment has the following advantages in contrast to the impeller assembly 300 according to a comparative embodiment.

First, since the washer 013 and the nut 021 in the impeller assembly 300 are not necessary for the impeller assembly 200, it is possible to allow the distance A between the rotor-side flange portion 68 and the compressor impeller 10 to be shorter than the distance A in the impeller assembly 300.

Thereby it becomes easy to secure a passage to introduce the air flowing between the motor rotor 40 and the stator 42 to the rotor blade 18 of the compressor impeller 10, as shown by the dashed arrow in FIG. 4. Thus, it is possible smoothly introduce the air flow passing through between the motor rotor 40 and the stator 42 to the rotor blades 18 of the compressor impeller 10 even when the thickness of the rotor-side flange portion 68 is secured to increase the strength of the rotor-side flange portion 68.

Further, it is possible to allow the distance B between the stator 42 and the compressor impeller 10 to be shorter than the distance B in the impeller assembly 300. In the impeller assembly 200, since it is thereby possible to arrange the magnet portion 50 in a position near the compressor impeller 10 corresponding to the position of the stator 42, the overhang amount D of the motor rotor 40 with respect to the compressor impeller 10 is shorter than the overhang amount D in the impeller assembly 300. When the overhang amount D is smaller, it is possible to suppress vibration of the shaft to a greater extent, and thus, it is advantageous in terms of the rotor dynamics, and the designing performance may be improved.

Further, in the impeller assembly 200, it is possible to allow the length C of the stator 42 in the axis line direction to be longer than the length C of the stator 042 of the impeller assembly 300. As the length of the stator 42 becomes longer, the contact length between the stator 42 and cooling air (dashed arrow in the drawing) flowing between the motor rotor 40 and the stator 42 becomes longer, whereby it is possible to improve efficiency of cooling the stator 42 (winding part).

In the impeller assembly 300, it is necessary to provide a bolt hole 059 on the end surface 058 of the hub 014 in order to fix the washer 013 to the end surface 058 of the hub 014 with the washer fixing bolt 017. In contrast, in the impeller assembly 200, as described above, by suitably setting the tightening force of the nut 54, it is possible to assemble the flange member 38, the compressor impeller 10 and the nut 54 together so as not to permit them to rotate relatively to one another by the friction force between the abutting portion 60 of the flange member 38 and the end surface 58 of the hub 14 and the friction force between the surface 70 on the motor rotor 40 side of the flange member 38 and the end surface 71 of the nut 54. Accordingly, since it is not necessary to provide a bolt hole to mount e.g. a washer on the end surface 58 of the hub, retrofitting of additionally providing a motor rotor 40 to the hub 14 may be easily performed.

Embodiments of the present invention were described in detail above, but the present invention is not limited thereto. Modifications may be made to the above embodiments, or some of the above embodiments may be suitably combined with each other, and embodiments obtained through such modification or combination are also within the scope of the present invention.

Figure 6:
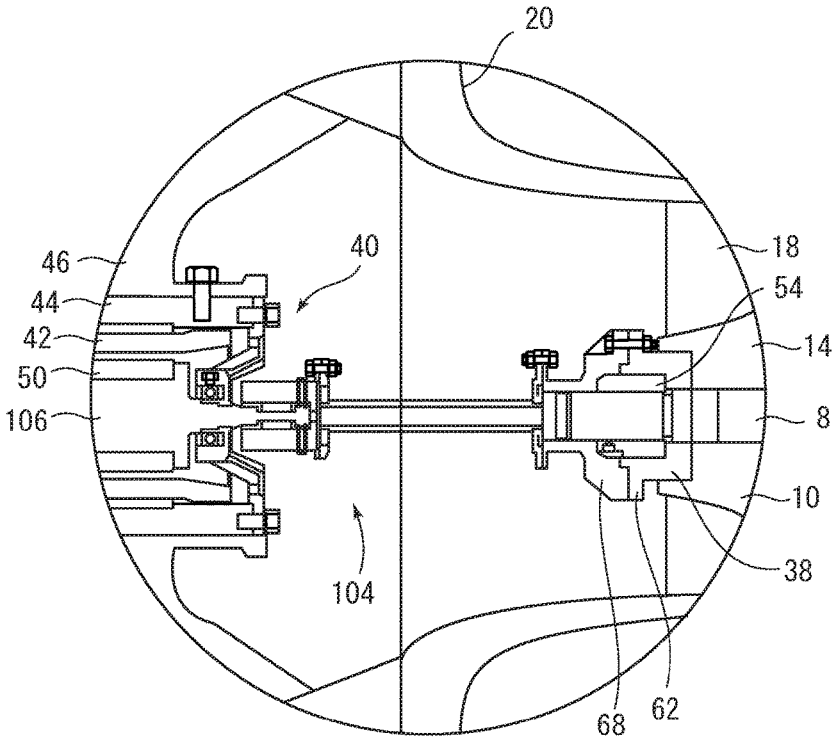
FIG. 6 is an enlarged view of connecting portion between motor rotor 40 and compressor impeller 10 employing flexible coupling 104.

For example, in an embodiment, as shown in FIG. 6, the motor rotor 40 may include a flexible coupling 104. In this case, the motor rotor 40 includes a rotor body portion 106 having a magnet portion 50, and the flexible coupling 104 for connecting the rotor body portion 106 and the flange member 38, and the rotor-side flange portion 68 is provided on one end side of the flexible coupling 104 and is fastened to the impeller-side flange portion 62 of the flange member 38. It is thereby possible to permit decentering, difference in angle or swinging between the rotational axis of the rotor body portion 106 and the rotational axis of the flange member 38.

In addition to a power assisted turbocharger having a built-in motor, which is above described as exemplary embodiments with reference to the drawings, the present invention may be applied to a hybrid turbocharger having an electric generator. In this case, the essential configuration is the same, as the rotor of the electric generator may function as the above motor rotor 40. With such a supercharger, electric power may be obtained by causing the compressor impeller and the rotor of the electric generator by the driving force of the turbine rotor, which is obtained from excessive exhaust gas energy.

The present invention may be applied to, in addition to the above-described exhaust gas turbine-type supercharger (i.e. turbocharger), a mechanically-driven supercharger which has a compressor driven by a power taken from the output shaft of the internal combustion engine via e.g. a belt.

DESCRIPTION OF REFERENCE NUMERALS

2 Compressor
4 Silencer
6 Motor
8 Shaft
9 Stepped portion
10 Compressor impeller
12 Compressor casing
14 Hub
15 Through-hole
16 Outer circumferential surface
18 Rotor blade
19 Rear surface
20 Air inlet casing
22 Scroll flow passage
24 Scroll casing
26 Flow passage
28 Diffuser flow path
30 Diffuser member
32 Silencer casing
34 Silencer element
36 Coupling casing
38 Flange member
40 Motor rotor
42 Stator
44 Motor casing
46 Supporting member
48 Rotor core
50 Magnet portion
53 Through-hole
54 Nut
55 Mating portion
56 Fastening member
58 End surface
60 Abutting portion
62 Impeller-side flange portion
64 Tip portion
66 Screw portion
68 Rotor-side flange portion
70 Surface
71 End surface
72 Socket-and-spigot joint structure
73 Socket-and-spigot joint structure
74 Convex portion for socket-and-spigot joint
75 Convex portion for socket-and-spigot joint
76 Concave portion for socket-and-spigot joint
77 Concave portion for socket-and-spigot joint
78 Bolt
79 Base end portion
80 Nut
82 Outer circumferential surface
84 Inclined surface
86 Head portion
88 Spot facing portion
90 Hub concave portion
91 Inner circumferential surface
92 Bottom surface
96 Flange member concave portion
98 Surface
100 Supercharger
102 Rotor concave portion
104 Flexible coupling
106 Rotor body portion
107 Lateral surface
108 Jig hole
200, 300 Impeller assembly
A Distance
B Distance
C Axis line
D Overhang amount
d Distance

What is claimed is:

1. An impeller assembly comprising:

a shaft;

a compressor impeller having a hub in which the shaft is inserted;

a flange member in which the shaft is inserted, the flange member having, at one end portion in a direction of an axis line, an abutting portion abutting on an end surface of the hub and, at another end portion in the direction of the axis line, an impeller-side flange portion protruding outward in a radial direction;

a nut screwed on a tip portion of the shaft so as to hold the flange member between the nut and the end surface of the hub;

a rotor of an electric generator or an electric motor, the rotor having a rotor-side flange portion disposed on an opposite to the hub across the impeller-side flange portion; and a fastening member fastening the impeller-side flange portion and the rotor-side flange portion to each other.

2. The impeller assembly according to claim 1, wherein the rotor and the flange member are assembled together by means of socket-and-spigot joint.

3. The impeller assembly according to claim 1, wherein the fastening member includes a flange fastening bolt for fastening the impeller-side flange portion and the rotor-side flange portion to each other, wherein the rotor-side flange portion has an outer circumferential surface having an inclined surface such that a distance between the inclined surface and the axis line becomes larger toward the hub, and wherein a spot facing portion accommodating the flange fastening bolt is provided on the inclined surface.

4. The impeller assembly according to claim 1, wherein the end surface of the hub has a hub concave portion formed, wherein the abutting portion abuts on a bottom surface of the hub concave portion, in the end surface, and wherein the nut is screwed on the tip portion of the shaft so as to hold the flange member between the nut and the bottom surface of the hub concave portion.

5. The impeller assembly according to claim 1, wherein the flange member has a flange member concave portion on a surface on a rotor side, wherein the rotor has a rotor concave portion on a surface on a flange member side, and wherein the nut is screwed on the shaft so as to exert a pressing force on a bottom surface of the flange member concave portion and is accommodated in a nut accommodation space formed by the flange member concave portion together with the rotor concave portion.

6. The impeller assembly according to claim 1, wherein the rotor includes a rotor body portion having a magnet portion, and a flexible coupling for connecting the rotor body portion and the flange member, and wherein the rotor-side flange portion is provided on one end side of the flexible coupling.

7. A supercharger comprising the impeller assembly as defined in claim 1.

8. A method of assembling an impeller assembly, the impeller assembly including:

a shaft;

a compressor impeller having a hub and a plurality of rotor blades provided on an outer circumferential surface and at intervals in a circumferential direction;

a flange member having an abutting portion to abut on an upstream-side end surface, in an axis line direction, of the hub, and an impeller-side flange portion to be provided on an upstream side, in the axis line direction, of the abutting portion and protruding outward in a radial direction;

a nut to be screwed on a tip portion of the shaft; and a rotor of an electric generator or an electric motor, the rotor having a rotor-side flange portion;

the method comprising:

an impeller inserting step of inserting the shaft into the compressor impeller;

a flange member inserting step of inserting the shaft into the flange member and permitting the abutting portion to abut on the end surface of the hub;

a nut screwing step of screwing the nut on the tip portion of the shaft so that the flange member is held between the nut and the end surface of the hub; and a fastening step of fastening the impeller-side flange portion and the rotor-side flange portion with a fastening member.

9. The method of assembling an impeller assembly according to claim 8, wherein the nut screwing step includes:

a temporary tightening step of tightening the nut temporarily; and a final tightening step of tightening the nut finally while applying a tensile force to a part of the tip portion of the shaft, the part being closer to a tip of the shaft than the nut having been temporarily tightened.

* * * * *